US005851142A

United States Patent [19]

Bullock

[11] Patent Number: 5,851,142

[45] Date of Patent: Dec. 22, 1998

[54] COMBINED GRINDING AND POLISHING TOOL

[75] Inventor: David W. Bullock, Medina, Ohio

[73] Assignee: Unisand Incorporated, Medina, Ohio

[21] Appl. No.: 824,392

[22] Filed: Mar. 26, 1997

[51] Int. Cl.[6] ..... B24D 13/02

[52] U.S. Cl. ..... 451/508; 451/464; 451/536

[58] Field of Search ..... 451/533, 532, 451/536, 537, 526, 508, 466, 465, 464

[56] References Cited

U.S. PATENT DOCUMENTS

| | | | |
|---|---|---|---|
| D. 351,773 | 10/1994 | Ward, Sr. | 8/70 D |
| 1,308,093 | 7/1919 | Merritt | 451/508 |
| 1,697,442 | 1/1929 | Webber . | |
| 2,156,492 | 5/1939 | Davis | 451/533 |
| 2,815,617 | 12/1957 | Bernstein . | |
| 2,958,593 | 11/1960 | Hoover et al. | 51/295 |
| 3,706,167 | 12/1972 | Schaffner | 451/466 |
| 4,275,529 | 6/1981 | Teetzel et al. | 451/466 |
| 4,712,552 | 12/1987 | Pangburn | 451/533 |
| 4,715,150 | 12/1987 | Takeuchi et al. | 451/527 |
| 5,125,192 | 6/1992 | Welsch | 451/527 |
| 5,142,829 | 9/1992 | Germain | 451/537 |
| 5,197,998 | 3/1993 | Germain | 51/297 |
| 5,247,767 | 9/1993 | Hadgis | 451/532 |
| 5,405,286 | 4/1995 | Welsch | 451/527 |
| 5,542,875 | 8/1996 | Ichiguchi | 451/533 |

FOREIGN PATENT DOCUMENTS

| | | |
|---|---|---|
| 2233811 | 1/1975 | France . |
| 673334 | 6/1952 | United Kingdom . |

*Primary Examiner*—Robert A. Rose

*Attorney, Agent, or Firm*—Fay, Sharpe, Beall, Fagan, Minnich & McKee

[57] ABSTRACT

An automotive aluminum wheel abrading/polishing tool is disclosed. The abrading/polishing tool includes a substantially circular, resilient, central layer of non-woven material. A first plurality of individual, circumferentially offset, layers or strips of scored sandpaper or other coated abrasive material are secured to a first side of the non-woven material. A second plurality of individual, circumferentially offset, layers or strips of scored sandpaper or other coated abrasive material are secured to a second side of the non-woven material. The strips of abrasive material function in the removal of burrs or excess aluminum, and the non-woven material produces a uniform finish by polishing a work piece surface. The strips of abrasive material and the non-woven material cooperate to define an axially resilient circumferential end edge which effectively abrades and polishes highly contoured workpiece surfaces. In addition, the abrading/polishing tool maintains a pre-determined abrasive grit rating as the tool is radially worn away during use.

20 Claims, 5 Drawing Sheets

COMBINED GRINDING AND POLISHING TOOL

BACKGROUND OF THE INVENTION

The present invention relates to the surface finishing arts. It finds particular application in conjunction with the abrading and polishing of cast aluminum wheels and will be described with particular reference thereto. However, it should be appreciated that the present invention also finds application in conjunction with the grinding and polishing of other metal or wooden objects and other applications which involve the removal of excess material and the polishing or buffing of the remaining material.

Several steps are typically involved in the manufacture of an aluminum automotive wheel. Initially, molten aluminum is poured into a wheel mold. The resulting rough casting is then abraded with a grinding tool to remove any burrs or excess material formed as a by-product of the initial casting step. The deburred casting is then polished or buffed with a polishing tool to smooth out the rough surfaces of the aluminum casting. After the aluminum wheel is polished, it may then be plated with chromium or a chromium alloy to provide a high-gloss finished surface, and/or coated with a clear-coat finish.

High-end (i.e., expensive) aluminum wheels are typically very aesthetic. That is, the high-end aluminum wheels are highly contoured and usually have a number of windows or apertures therethrough. In addition, each aperture may have a differing radius and/or depth. As such, the deburring and polishing of high-end aluminum wheels is made difficult by the size, shape and number of windows or apertures projecting through the wheels.

In particular, an abrading tool for use in abrading excess material from an aluminum wheel must be compliant or resilient enough to contact the contoured side walls defining the apertures through the wheel and yet must be strong or stiff enough to actually remove any excess aluminum or burrs. Likewise, a polishing tool for use in polishing or buffing an aluminum wheel must be compliant or resilient enough to contact the contoured side walls and yet be strong or stiff enough to buff or polish the side wall surfaces.

Automated abrading and polishing equipment is commonly used for finishing aluminum wheels that incorporate simple design patterns (i.e., design patterns with little or no contours or apertures). An abrasive flap wheel is rotatably secured to the equipment for actually abrading and polishing aluminum wheels. Abrasive flap wheels have also been rotatably secured to hand-held abrading and polishing equipment for surface finishing aluminum wheels. An exemplary flap wheel 10 for use with known automated and hand-held abrading and polishing equipment is shown in FIG. 10.

The abrasive flap wheel 10 includes an annulus 12 of slotted, substantially rectangular, like-oriented coated abrasive flaps 14 interleaved with non-woven flaps 16. The inner ends of the coated abrasive flaps 14 and the non-woven flaps 16 are adhesively bonded together by an adhesive binder. The free ends of the flaps 14, 16 cooperate to define a resilient abrading/polishing surface or edge 18. The flap wheel 10 also includes circular side plates 20 which cooperate with the flaps 14, 16 to form a substantially solid hub 22 having a aperture therethrough for axially receiving an arbor. The hub 22 constraints the flaps 14, 16, and hence the abrading/polishing surface 18, to movement in a circumferential direction only. That is, the side edges of the flaps 14, 16 are constrained from any movement in an axial direction.

As disclosed in U.S. Pat. Nos. 3,706,167 and 4,275,529, the abrasive flap wheel 10 produces a two-fold blended finish in a single finishing operation. That is, the abrasive flap wheel produces a deep cut while at the same time leaving a work-piece with a soft fine surface finish. However, the flap wheel 10 has limited utility in the surface finishing arts regardless of the type of abrading and polishing equipment used. In particular, the flap wheel 10 is only useful for finishing substantially planar work surfaces such as the bottoms of cooking utensils, and aluminum wheels incorporating simple design patterns. In particular, the abrading and polishing of a work piece is limited to contacting the work piece with only the circumferential abrading/polishing surface 18 of the flap wheel 10.

Since the flaps 14, 16 are constrained to circumferential movement only, the abrading/polishing surface 18 is not compliant or resilient enough to contact the highly contoured side walls defining an aperture through an automotive wheel. In addition, as the flap wheel 10 is radially worn away during use, the abrading/polishing surface 18 becomes less compliant or resilient due to the increasing density of the flaps 14, 16 proximate the hub 22. That is, the resiliency of the abrading/polishing surface 18 decreases as the flap wheel 10 wears radially inwardly toward the substantially solid hub 22 throughout the lifetime of the flap wheel 10, thus making it increasingly difficult to reach the highly contoured side surfaces of the apertures as the flap wheel is worn away.

Accordingly, it has been considered desirable to develop a new and improved combined grinding and polishing tool which meets the above-stated needs and overcomes the foregoing difficulties and others while providing better and more advantageous results.

SUMMARY OF THE INVENTION

In accordance with a first aspect of the present invention, a surface finishing tool includes a first substantially planar layer of non-woven material having a first surface and a second surface, a second substantially planer layer of abrasive material positioned adjacent the first surface, a third substantially planar layer of abrasive material positioned adjacent the second surface, and a binder which secures the first, second, and third substantially planar layers together.

In accordance with a second aspect of the present invention, a method of manufacturing a surface finishing tool includes the step of securing a central layer of non-woven material between a first planar layer of abrasive material and a second planar layer of abrasive material.

One advantage of the present invention is the provision of an abrading/polishing tool which uses a combination of abrasive slashed material and non-woven material to simultaneously remove excess material from a workpiece and polish the workpiece.

Another advantage of the present invention is the provision of an abrading/polishing tool which maintains a predetermined abrasive grit rating as abrasive material is radially worn away during use.

Another advantage of the present invention is the provision of an abrading/polishing tool which has an axially resilient circumferential end edge which effectively abrades and polishes highly contoured workpiece surfaces.

Another advantage of the present invention is the provision of an abrading/polishing tool which incorporates a narrow one-eight inch slash pattern that breaks down during use to form a soft, circumferential end edge that produces a soft, consistent finish to a work piece.

Still further advantages of the present invention will become apparent to those of ordinary skill in the art upon reading and understanding the following detailed description of the preferred embodiments.

BRIEF DESCRIPTION OF THE DRAWING

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
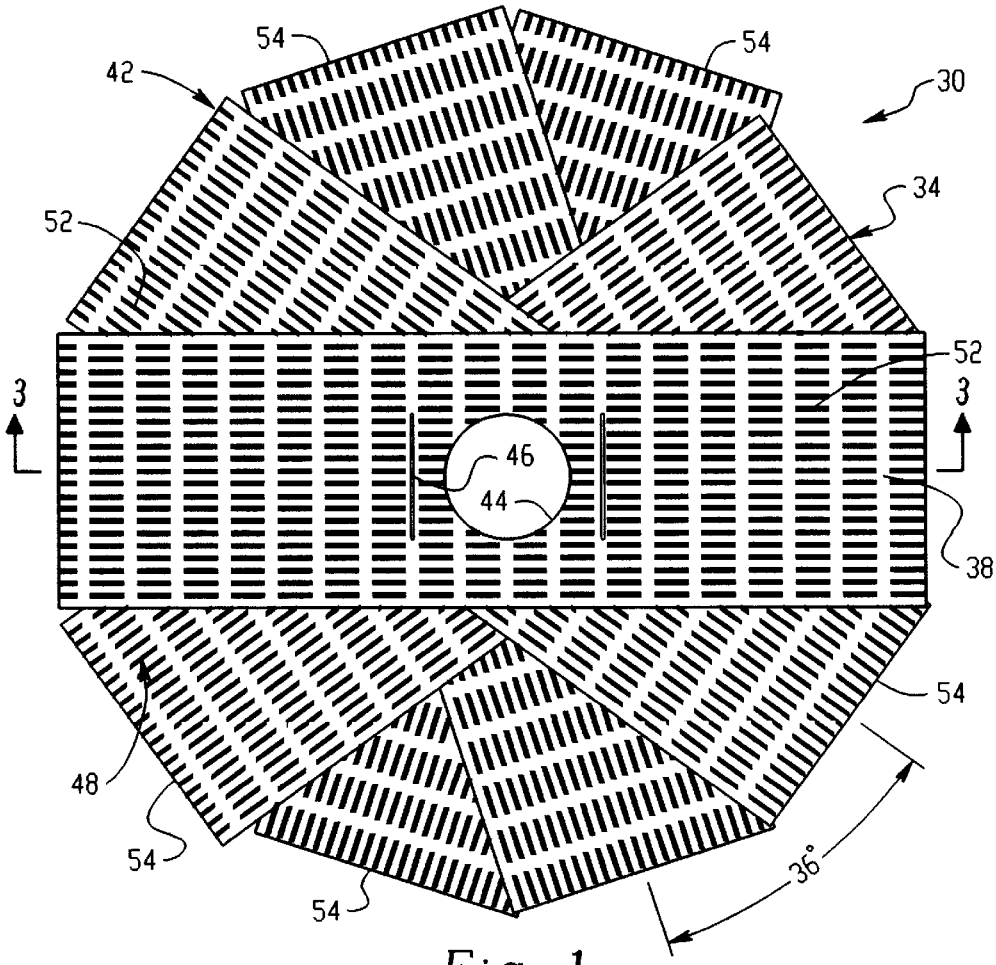
FIG. 1 is top view of a first grinding and polishing tool which incorporates the features of the present invention therein.
Figure 2:
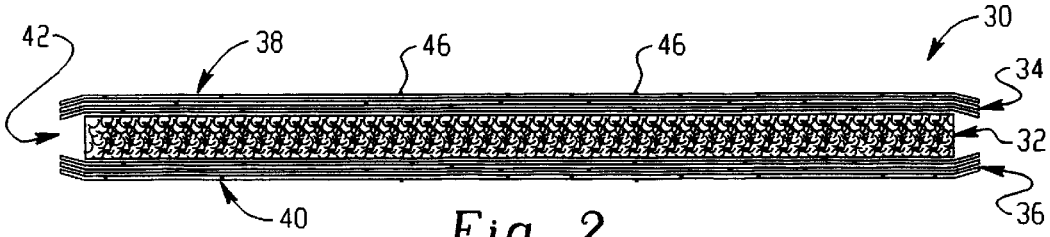
FIG. 2 is a side view of the grinding and polishing tool taken along the line 2—2 of FIG. 1.
Figure 3:
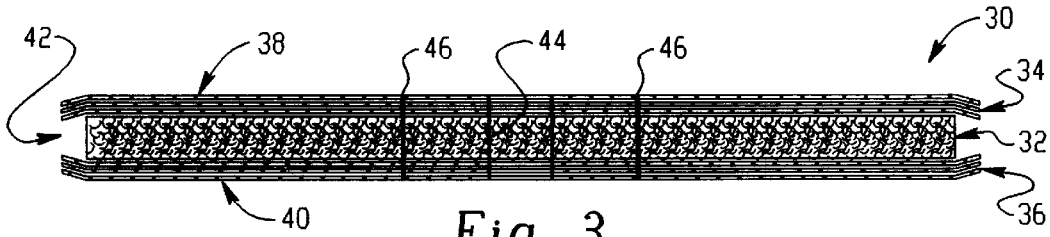
FIG. 3 is a cross section view of the grinding and polishing tool taken along the line 3—3 of FIG. 1.

With reference to FIGS. 1–3, an automotive aluminum wheel abrading/polishing tool 30 includes a substantially circular, resilient, central layer of non-woven material 32. The non-woven material 32 includes a three-dimensional substrate, which may be a porous, fibrous, non-woven construction. The substrate may be formed from nylon, or the like.

A first plurality of individual, circumferentially offset, layers or strips of scored sandpaper or other coated abrasive material 34 are secured to a first side of the non-woven material 32. Likewise, a second plurality of individual, circumferentially offset, layers or strips of scored sandpaper or other coated abrasive material 36 are secured to a second side of the non-woven material 32.

The strips of abrasive material 34, 36 function in the removal of burrs or excess aluminum, and the non-woven material produces a uniform finish by polishing a work piece surface as described in detail below. The non-woven material also increases the stability of the abrading/polishing tool 30 by providing a cooler surface temperature and greater cushioning during use. In addition, the non-woven material increases the lifespan of the abrading/polishing tool.

The strips of abrasive material 34, 36 are each positioned with a coated abrasive surface thereof oriented away from the non-woven material 32. The first strips of abrasive material 34 partially overlap each other to define a first abrasive side surface 38. The second strips of abrasive material 36 partially overlap each other to define a second abrasive side surface 40.

The strips of abrasive material 34, 36 extend radially outwardly to substantially the same extent as the layer of non-woven material 32. Thus, the non-woven material 32 and the strips of abrasive material 34, 36 cooperate to define a substantially circular disk or wheel having an angular or discontinuous circumferential end edge 42.

A bore 44 extends centrally through the abrading/polishing tool 30. The bore 44 facilitates mounting the abrading/polishing tool 30 to a rotatably-driven coupling such as an arbor, in a known manner. The non-woven material 32 and the strips of abrasive material 34, 36 are secured or joined together by at least two staples 46 penetrating therethrough on opposing sides of the bore 44. However, other methods of joining the non-woven material 32 and the strips of abrasive material 34, 36 together are contemplated.

Each strip of abrasive material 34, 36 has a slash pattern 48 incorporated therein which is designed to break down or tear the strips of abrasive material in a radially inward direction during use, thereby producing a soft circumferential end edge 42. The slash pattern 48 is formed from a plurality of rows 50 which are spaced apart in a longitudinal direction of the strip of abrasive material.

Each row 50 is formed from a plurality of slashes 52 which are scored through the abrasive material 34, 36. In the embodiment being described, adjacent rows 50 are spaced approximately 0.125 inches apart in a longitudinal direction, and adjacent slashes 52 which form each row 50 are approximately 0.5 inches long and spaced approximately 0.125 inches apart. In addition, it has been found that a coated abrasive material incorporating an X-weight, water-proof, cotton backing material provides the desired amount of resiliency.

Coated abrasive material is also available with rows of slashes and adjacent slashes spaced from 0.25 to 0.50 inches apart. It should be appreciated that slash patterns incorporating such 0.25 to 0.50 slash spacing patterns break down during use to form larger/wider fingers or flaps 54 (discussed further below) than the coated abrasive material incorporating the 0.125 inch slash spacing pattern. A disadvantage associated with larger/wider flaps 54 is that the flaps tend to fold over during use thus exposing more backing material which scratches or otherwise damages the surface of the work piece, thereby producing inconsistent results.

A non-woven material 32 suitable for use with the present invention is SCOTCHBRITE which is commercially available from 3M Corporation. Another non-woven material suitable for use with the present invention is JOHN COTTON which is commercially available from John Cotton Mirfield Ltd., of West Yorkshire, England. In the embodiment being described, the non-woven material 32 has a thickness in the range of about 0.1825 to about 0.50 inches, and preferably about 0.25 inches.

The abrading/polishing wheel 30 is manufactured by cutting a continuous web of scored abrasive material into strips 34, 36 each having substantially the same length. Strips of abrasive material are overlapped in a circumferentially offset manner to form the first abrasive side surface 38. Additional strips of abrasive material are overlapped in the same circumferentially offset manner to form the second abrasive side surface 40. The non-woven material 32 is positioned between the abrasive side surfaces 38, 40, and then joined thereto with the staples 46. The central bore 44 is formed by die cutting the resulting abrading/polishing tool 10.

In the embodiment being described, ten (10) strips of abrasive material 34, 36 form each of the abrasive side surfaces 38, 40. Five (5) of the ten (10) strips of abrasive material forming the abrasive side surface 38 are visible in FIG. 1. Adjacent strips of abrasive material 34, 36 are circumferentially offset by approximately 36°.

In operation, the circumferential end edge 42 simultaneously abrades and polishes a work piece. In particular, the layers of abrasive material 34, 36 forming a portion of the circumferential end edge 42 abrade away excess material and burrs from the work piece. The non-woven material 32 forming the other portion of the circumferential end edge 42 simultaneously buffs or polishes the surface of the workpiece that is abraded by the abrasive material.

The non-woven material 32 also provides a resilient axial spring force which urges the abrasive material 34, 36 into contact with the workpiece against an axial deflection force applied to the circumferential end edge 42 when the end edge 42 is contacting a workpiece. In particular, the planar orientation of the strips of abrasive material 34, 36 in combination with the non-woven material 32 facilitate resiliently deflecting the abrading/polishing tool 30 in axial directions to permit the circumferential end edge 42 and the abrasive side surfaces 38, 40 to contact highly contoured surfaces such as contoured side walls defining apertures in an aluminum wheel.

Figure 4:
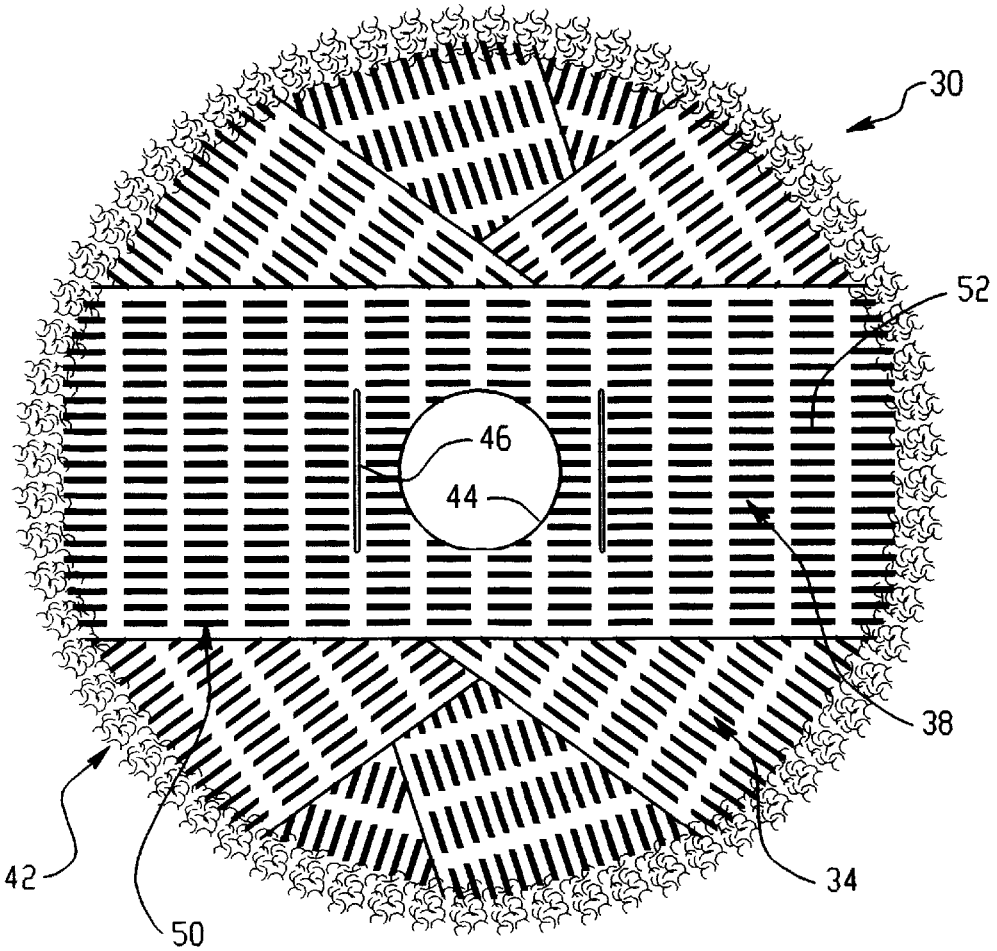
FIG. 4 is a top view of the first grinding and polishing tool of FIG. 1 having a circumferential end edge which has been worn down through use.
Figure 5:
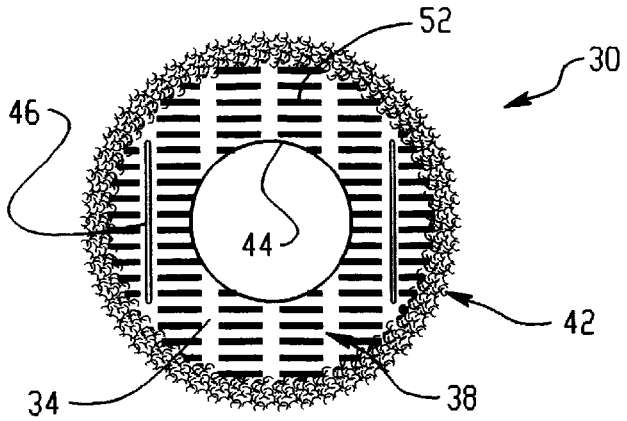
FIG. 5 is a top view of the first grinding and polishing tool of FIG. 1 wherein circumferential end edge has been further worn down through use.

As shown in FIGS. 4 and 5, the circumferential end edge 42 of abrading/polishing tool 30 wears radially inwardly during use to produce a "soft" circumferential end edge 42. In particular, contacting a work piece with the circumferential end edge 42 causes the end edge of each strip of abrasive material 34, 36 to randomly break down and tear along the slashes 52 thereby forming a plurality of flexible abrasive fingers or flaps 54. The resulting abrasive flaps 54 are highly compliant and cooperate with the non-woven material 32 to provide the softness characteristic to the circumferential end edge 42.

Since the score patterns 48 extend continuously across the complete diameter of the abrading/polishing tool 30, the abrading and polishing characteristics of the circumferential end edge 42 are maintained at a substantially constant level as the circumferential end edge wears radially inwardly (contrast FIGS. 4 and 5).

It should be appreciated that as the diameter of the abrading/polishing wheel decreases through use, the ability of the abrading/polishing tool to reach into smaller or more highly contoured apertures of an automotive wheel increases. Thus, the larger diameter, and hence newer abrading/polishing tool of FIG. 4 may be replaced with the smaller diameter, and hence older abrading/polishing tool of FIG. 5 so as to more effectively abrade and polish the smaller or more highly contoured work surfaces without altering the ability to simultaneously abrade and polish a workpiece. Thus, it is contemplated that a surface finishing operation may be performed with a number of different diameter abrading/polishing tools 30 depending upon the shape of the workpiece to be finished, with each abrading/polishing tool providing substantially similar abrading and polishing characteristics.

Figure 6:
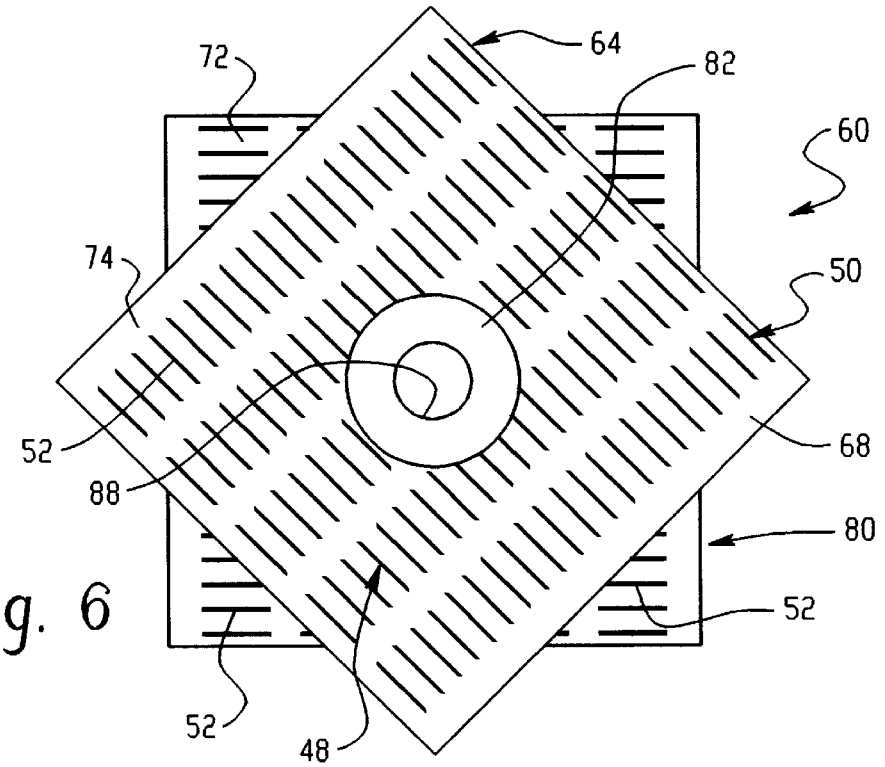
FIG. 6 is top view of a second grinding and polishing tool which incorporates the features of the present invention therein.
Figure 7:
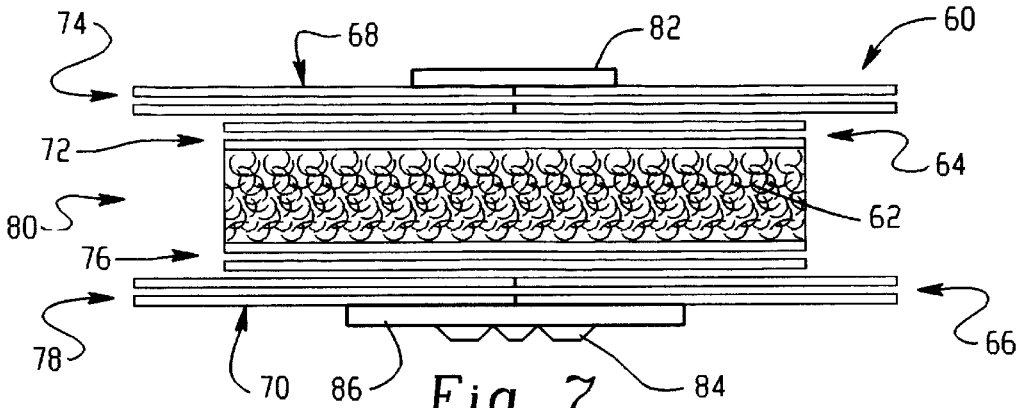
FIG. 7 is a side view of the second grinding and polishing tool taken along the line 7—7 of FIG. 6.
Figure 8:
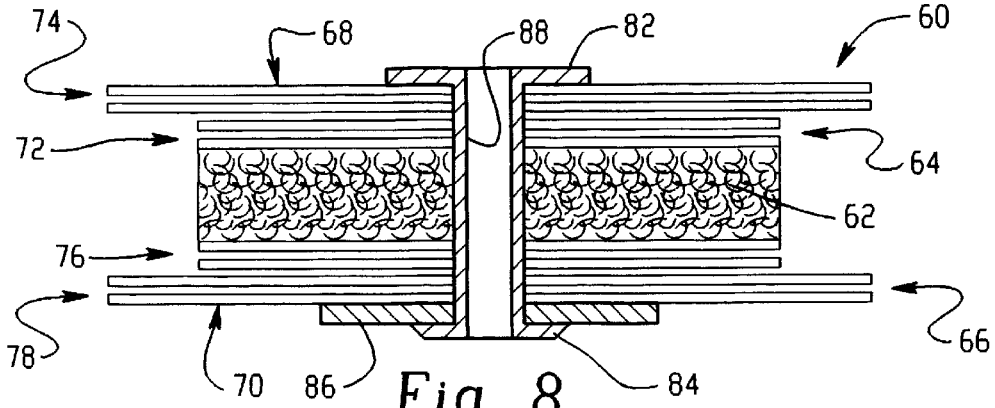
FIG. 8 is a cross section view of the second grinding and polishing tool taken along the line 8—8 of FIG. 6.

Referring now to FIGS. 6–8, there is shown another automotive aluminum wheel abrading/polishing tool 60. The abrading/polishing tool 60 includes a central layer of non-woven material 62. A first plurality of layers or strips of scored sandpaper or other coated abrasive material 64 are secured to a first side of the non-woven material 62. Likewise, a second plurality of layers or strips of scored sandpaper or other coated abrasive material 66 are secured to a second side of the non-woven material 62. The strips of abrasive material 64, 66 function in the removal of burrs or excess aluminum, and the non-woven material 62 produces a uniform finish by polishing a work piece surface.

The strips of abrasive material 64, 66 are each positioned with a coated abrasive surface thereof oriented away from the non-woven material 62. The first strips of abrasive material 64 cooperate to define a first abrasive side surface 68. The second strips of abrasive material 66 cooperate to define a second abrasive side surface 70.

The strips of abrasive material 64, 66 and the non-woven layer 62 each have substantially the same size (i.e. length and width). As best shown in FIGS. 4 and 5, the first abrasive side surface 68 includes one or more strips of abrasive material 72 aligned with the non-woven material 62, and one or more strips of abrasive material 74 circumferentially offset from the strips of abrasive material 72 and the non-woven material 62.

Likewise, the second abrasive side surface 70 includes one or more strips of abrasive material 76 aligned with the non-woven material 62, and one or more strips of abrasive material 78 circumferentially offset from the strips of abrasive material 76 and the non-woven material 62. In the embodiment being described, the strips of abrasive material 74, 78 are offset by approximately 45° from the strips of abrasive material 72, 76 so as to define an undulating circumferential end edge 80.

A grommet or eyelet 82 extends centrally through the abrading/polishing tool 60. The grommet 82 secures or joins the non-woven material 62 and the strips of abrasive material together. However, other methods of joining the non-woven material 62 and the strips of abrasive material 64, 66 together are contemplated.

Figure 9:
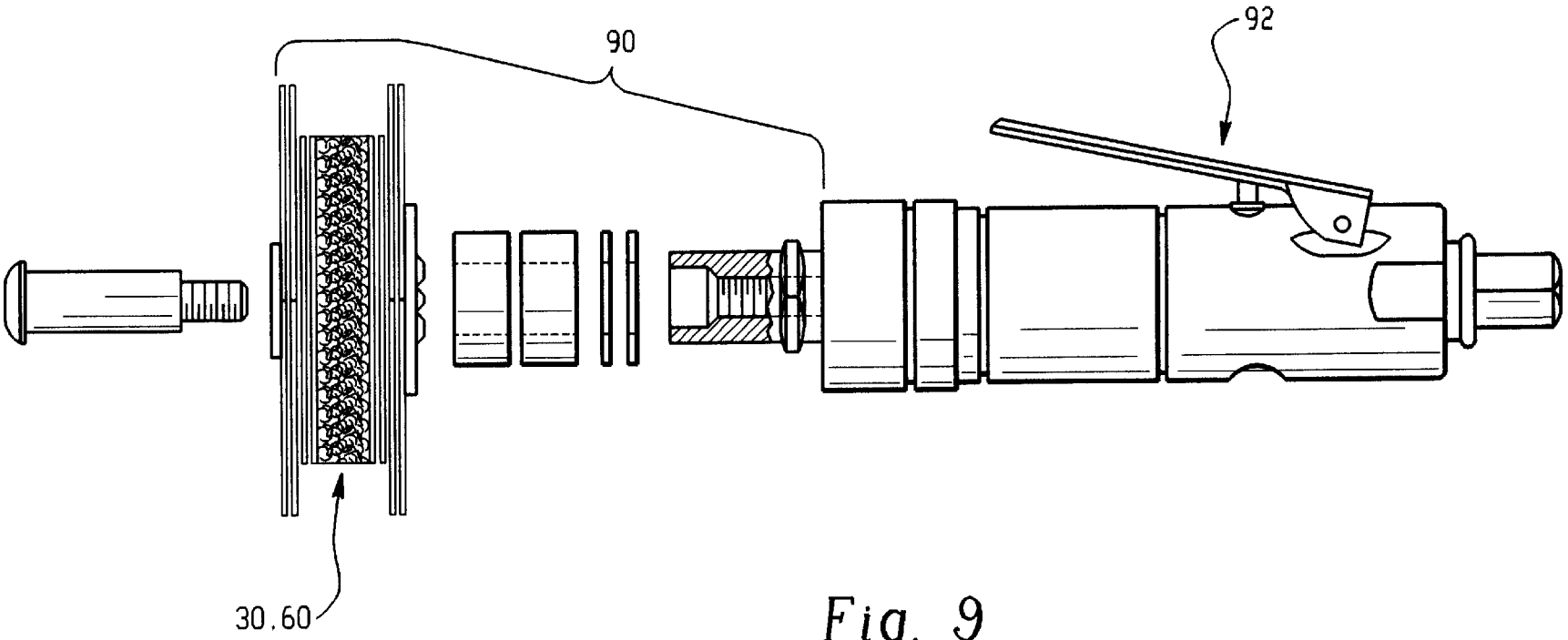
FIG. 9 is an exploded view of rotary power tool for use with the first and second grinding and polishing tools of the present invention.
Figure 10:
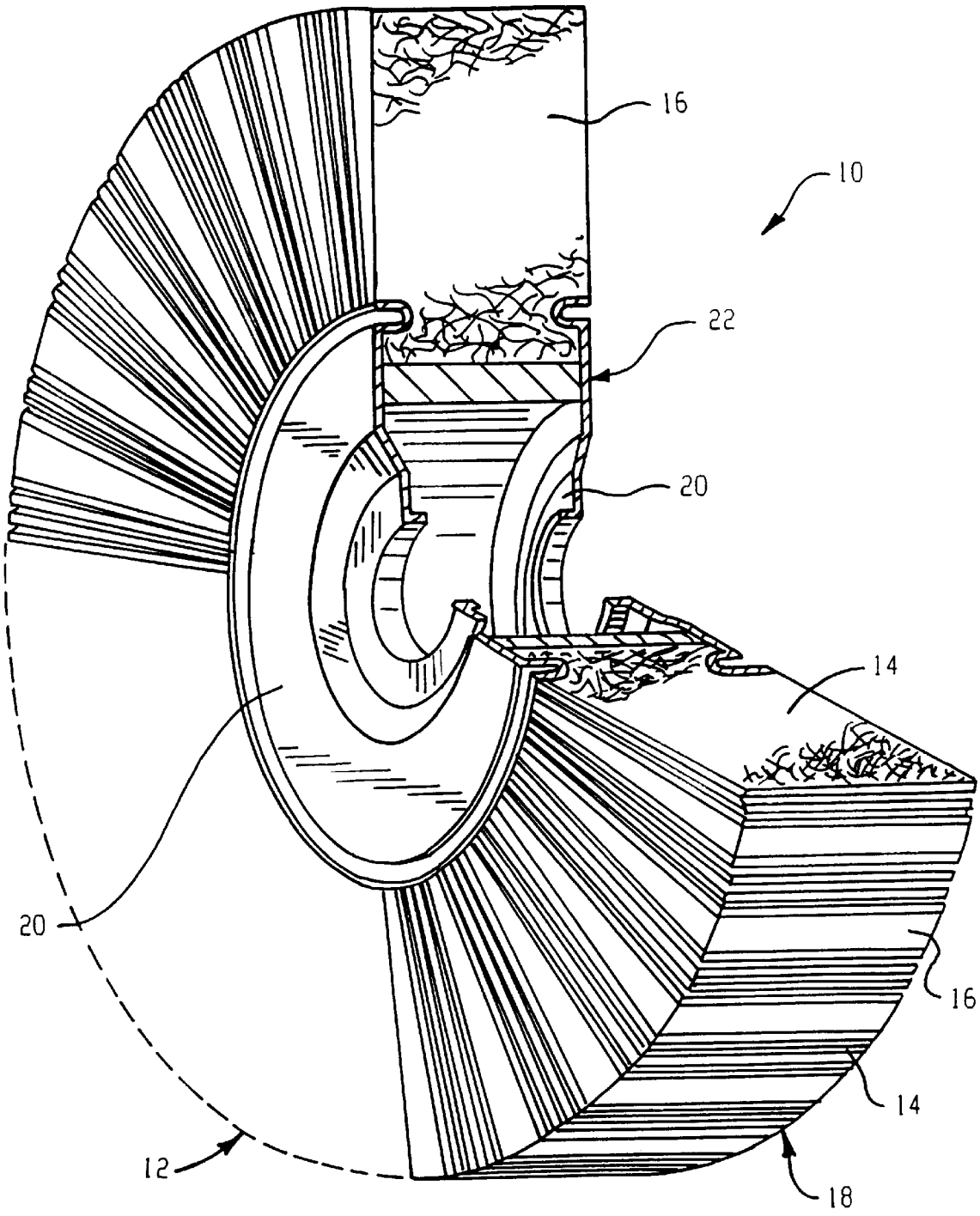
Fig. 10 (Prior Art)
FIG. 10 is a perspective cut-away view of a known abrasive flap wheel.

In the embodiment being described, the grommet 82 includes a staked portion 84 which forces the non-woven material 62 and the strips of abrasive material together. A washer 86 may be positioned between the staked portion 84 and the abrasive material. The grommet 82 also includes a threaded bore 88 which facilitates mounting the abrading/polishing tool 60 to a rotatably-driven coupling 90 such as an arbor of a power tool 92 as shown in FIG. 9.

Each strip of abrasive material 64, 66 has the same slash pattern 48 incorporated therein which is designed to break down or tear the strips of abrasive material in a radially inward direction during use, thereby producing a soft circumferential end edge 80. As previously described, the slash pattern 48 is formed from a plurality of rows 50 which are spaced apart in a longitudinal direction. Each row 50 is formed from a plurality of slashes 52 which are scored through the abrasive material 64, 66.

The abrading/polishing wheel 60 is manufactured by cutting a continuous web of scored abrasive material into substantially square strips 64, 66 each having four sides with substantially the same length. In the embodiment being described, the first abrasive side surface 68 is formed from two (2) strips of abrasive material 72 aligned with the non-woven material 62, and two (2) strips of abrasive material 74 circumferentially offset from the strips of abrasive material 72 and the non-woven material 62. Likewise, the second abrasive side surface 70 is formed from two (2) strips of abrasive material 76 aligned with the non-woven material 62, and two (2) strips of abrasive material 78 circumferentially offset from the strips of abrasive material 76 and the non-woven material 62.

In operation, the undulating end edge 80 simultaneously abrades and polishes a work piece. In particular, the layers of abrasive material 64, 66 forming a portion of the undulating end edge 80 abrade away excess material and burrs from the work piece. The non-woven material 62 forming the other portion of the circumferential end edge 80 simultaneously buffs or polishes the surface of the workpiece that is abraded by the abrasive material.

The non-woven material 62 also provides a resilient axial spring force which urges the abrasive material 64, 66 into contact with the workpiece against an axial deflection force applied to the undulating end edge 80 when the end edge 80 is contacting a workpiece. In particular, the planar orientation of the strips of abrasive material 64, 66 in combination with the non-woven material 62 facilitate resiliently deflecting the abrading/polishing tool 60 in axial directions to permit the undulating end edge 80 and the abrasive side surfaces 68, 70 to contact highly contoured surfaces such as contoured side walls defining apertures in an aluminum wheel.

The undulating end edge 80 of the abrading/ polishing tool 60 wears radially inwardly during use to produce a "soft" circumferential end edge 80. In particular, contacting a work piece with the undulating end edge 80 causes the end edge of each strip of abrasive material 64, 66 to randomly break down and tear along the slashes 52 thereby forming a plurality of flexible abrasive fingers or flaps 54. The resulting abrasive flaps 54 are highly compliant and cooperate with the non-woven material 62 to provide the softness characteristic to the end edge 80.

Since the score patterns 48 extend continuously across the complete diameter of the abrading/polishing tool 60, the abrading and polishing characteristics of the edge 80 are maintained at a substantially constant level as the end edge wears radially inwardly.

It should be appreciated that as the diameter of the abrading/polishing tool decreases through use, the ability of the abrading/polishing tool to reach into smaller or more highly contoured apertures of an automotive wheel increases. Thus, the larger diameter, and hence newer abrading/polishing tools may be replaced with the smaller diameter, and hence older abrading/polishing tools to more effectively abrade and polish smaller or more highly contoured work surfaces without altering the ability to simultaneously abrade and polish a workpiece.

What has been described is an abrading/polishing tool 30, 60 which utilizes abrasive slashed material to remove excess material from a workpiece and a central layer of non-woven material to polish the workpiece. The abrading/polishing tool 30, 60 maintains a pre-determined abrasive grit rating as the abrasive material, and hence the polishing pad is radially worn away during use. The abrading/polishing tool 30, 60 has an axially resilient circumferential end edge which effectively abrades and polishes highly contoured workpiece surfaces.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

For instance, it is contemplated that an abrading/polishing tool may include a circular central layer of non-woven material secured between one or more stacked or circumferentially-aligned layers of circular abrasive material.

In addition, one or more layers of abrasive material may form the abrasive side surfaces. Multiple layers of abrasive material may be circumferentially offset to any degree. Alternatively, multiple layer of abrasive material may be aligned with each other. An abrasive side surface may be formed from a single continuous web of abrasive material which is folded back and layered across itself to form the abrasive side surface. Alternatively, the abrasive material may be cut or stamped into various sizes and dimensions, and may be cut or stamped to form a single sheet of abrasive material. The abrasive material may incorporate a different slash pattern therein.

Still further, the non-woven material 32 may have various widths and coarseness ratings such as UF (ultra-fine), VF (very-fine), M (medium), C (course), etc. The non-woven material 32 may also have various abrasive materials embedded therein such as aluminium oxide, silicon carbide, alumina zirconia, diamond, ceria, cubic boron nitride, garnet, or a combination thereof.

Likewise, the abrasive material 34, 36 may have various abrasive grains bonded or coated thereon such as aluminium oxide or silicon carbide in varying grit sizes. The abrasive material 34, 36 may incorporate various backing materials such as cloth, paper, vulcanized fiber, or polymeric film. The binder coating may include phenolic resin, urea-formaldehyde resin, acrylate resin, epoxy resin, aminoplast resin, hyde glue, urethane resin, polyester resin, or a combination thereof. The abrasive material 34, 36 may be replaced with addition non-woven layers having a coarseness rating different from that of the non-woven layer 32.

Having thus described the preferred embodiments, the invention is now claimed to be:

1. A surface finishing tool, comprising:

a first substantially planar layer of non-woven material having a first surface and a second surface;

a second substantially planer layer of abrasive material positioned adjacent the first surface;

a third substantially planar layer of abrasive material positioned adjacent the second surface; and a binder securing central portions of the first, second, and third substantially planar layers together thereby leaving radial end portions of the first, second, and third substantially planar layers free to conform to the contours of a workpiece to be finished.

2. The surface finishing tool of claim 1, wherein the second substantially planar layer includes at least one sheet of abrasive material.

3. The surface finishing tool of claim 2, wherein the third substantially planar layer includes at least one sheet of abrasive material.

4. The surface finishing tool of claim 1, wherein the second substantially planar layer includes a first plurality of overlapping and circumferentially offset strips of abrasive material.

5. The surface finishing tool of claim 4, wherein the third substantially planar layer includes a second plurality of overlapping and circumferentially offset strips of abrasive material.

6. The surface finishing tool of claim 5, wherein each of the first plurality and second plurality of strips of abrasive material has a first end and a second end, and has slash pattern scored therein from the first end to the second end.

7. The surface finishing tool of claim 4, wherein each of the first plurality of strips of abrasive material has a first end and a second end, and has slash pattern scored therein from the first end to the second end.

8. The surface finishing tool of claim 1, further including a central aperture extending through the first, second, and third substantially planar layers for engagement with a rotatable power tool.

9. The surface finishing tool of claim 1, further including a grommet extending through the first, second, and third substantially planar layers for engagement with a rotatable power tool.

10. The surface finishing tool of claim 1, wherein the binder includes at least one staple extending through the first, second, and third substantially planar layers.

11. The surface finishing tool of claim 1, wherein the first substantially planar layer, second substantially planer layer, and third substantially planar layer cooperate to define an angular circumferential end surface.

12. The surface finishing tool of claim 1, wherein the first substantially planar layer, second substantially planer layer, and third substantially planar layer cooperate to define an undulating circumferential end surface.

13. The surface finishing tool of claim 1, wherein the first substantially planar layer, second substantially planer layer, and third substantially planar layer cooperate to define a circular circumferential end surface.

14. The surface finishing tool of claim 1, wherein the non-woven material has a thickness in the range of about 0.1825 to about 0.50 inches.

15. The surface finishing tool of claim 1, wherein the non-woven material has a thickness of about 0.25 inches.

16. The surface finishing tool of claim 1, wherein the first and second substantially planar layers each include about 4 to about 15 overlapping and circumferentially-offset strips of abrasive material.

17. The surface finishing tool of claim 1, wherein the second and third substantially planar layers of abrasive material each incorporate a slash pattern having a first plurality of slashes defining a first row and a second plurality of slashes defining a second row where the first row is spaced approximately 0.125 inches from the second row.

18. The surface finishing tool of claim 17, wherein the first plurality of slashes are spaced approximately 0.125 inches apart.

19. A method of manufacturing a surface finishing tool comprising the step of:

positioning a central layer of non-woven material between a first substantially planar layer of abrasive material and a second substantially planar layer of abrasive material; and securing central portions of the non-woven material, first layer, and second layer together thereby leaving radial end portions of the non-woven, first, and second layers free to conform to the contours of a workpiece to be finished.

20. The method of claim 19, further including the steps of:

overlapping a first plurality of strips of abrasive material in a circumferentially offset manner to form the first planar layer of abrasive material; and overlapping a second plurality of strips of abrasive material in a circumferentially offset manner to form the second planar layer of abrasive material.

* * * * *